United States Patent [19]

Sefton

[11] 4,310,835

[45] Jan. 12, 1982

[54] SECURITY EQUIPMENT INCLUDING TRIGGER CIRCUIT

[75] Inventor: Philip C. Sefton, London, England

[73] Assignee: Donald Arthur Arnold, London, England

[21] Appl. No.: 120,644

[22] Filed: Feb. 11, 1980

[30] Foreign Application Priority Data

Feb. 9, 1979 [GB] United Kingdom ..... 04578/79

[51] Int. Cl.[3] ..... G08B 25/00

[52] U.S. Cl. ..... 340/533; 340/524; 340/537; 340/545; 307/100

[58] Field of Search ..... 340/514, 517, 521, 524, 340/533, 531, 537, 545; 307/100, 116

[56] References Cited

U.S. PATENT DOCUMENTS

| | | | |
|---|---|---|---|
| 3,588,865 | 6/1971 | Hansen | 340/501 |
| 3,626,403 | 12/1971 | Ive | 340/541 |
| 4,118,700 | 10/1978 | Lenihan | 340/545 |

FOREIGN PATENT DOCUMENTS

| | | |
|---|---|---|
| 1766735 | 8/1971 | Fed. Rep. of Germany . |
| 2132161 | 1/1973 | Fed. Rep. of Germany . |
| 1429781 | 3/1976 | United Kingdom . |

*Primary Examiner*—Alvin H. Waring

*Attorney, Agent, or Firm*—Wenderoth, Lind & Ponack

[57] ABSTRACT

Security equipment comprises a plurality of normally-open or normally-closed switch contacts connected in a loop circuit to a central control circuit. Each pair of switch contacts has a respective resistor connected in parallel therewith and the control circuit is operable to detect changes in resistance due, for example, to an intruder operating one of the switches.

10 Claims, 12 Drawing Figures

R28
R29
D7
A
R7
C7
TR6
R6
R12
D5
R23
D6
R5
C5
TR5
R21
C4
R10
R9
C12
C8
R24
R25
TR3
R27
TR7
R4
D1
R3
F1
C1
Z1
TR1
Z2
+12V
0V
R13
C9
R14
TR8
R26
R22
R55
R54
C10
TR4
D4
B
R20
8
9
10
7
5
6
2
3
11
12
13
14
23
22

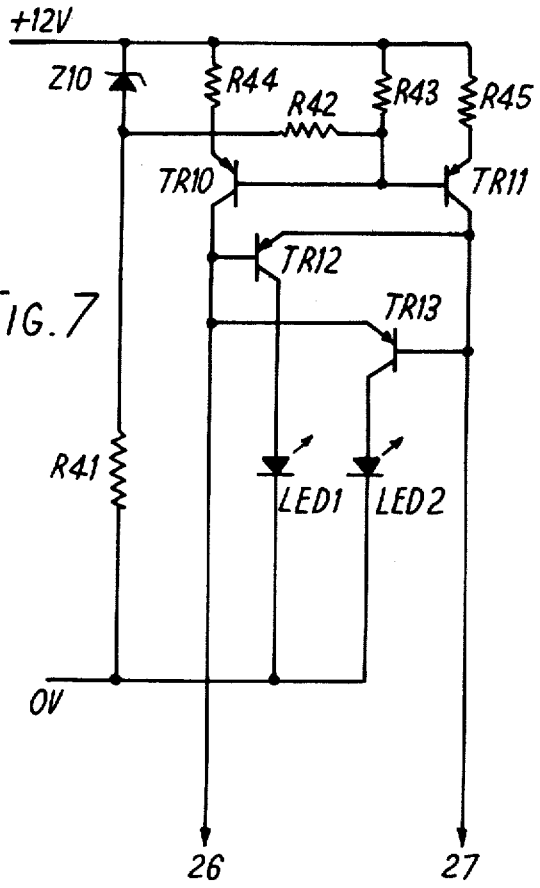
FIG. 7
FIG. 8
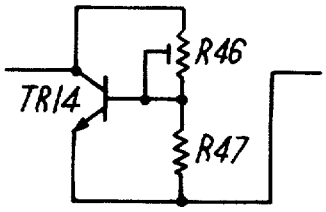
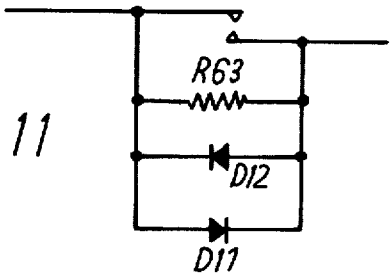
FIG. 11

SECURITY EQUIPMENT INCLUDING TRIGGER CIRCUIT

BACKGROUND OF THE INVENTION

This invention relates to wired security equipment of the type commonly used in buildings to provide audible or similar alarm when an intruder enters the premises.

Existing wired security equipment generally comprises a plurality of electrical contacts each mounted on a respective door or window of the premises so as to be operated when that door or window is opened. The equipment may also incorporate floor pressure mats which open or close contacts when stepped upon. The door and window contacts may be of the normally closed or normally open types, and a known equipment utilizing normally-closed types is shown by way of example in FIG. 1 of the accompanying drawings.

In FIG. 1, a plurality of pairs of normally closed contacts S1 to S4 are connected in series to form a closed loop, known as the "detection circuit". A second closed loop, known as the "monitoring circuit" accompanies the detection circuit in close physical proximity therewith. Because of this close physical proximity, any damage, whether accidental or otherwise, to the detection circuit is likely to affect the monitoring circuit as well, thus enabling such damage to be detected.

Both detection and monitoring circuits terminate in a control circuit 1 which is able to detect, by a cessation in current flow, when any one or more of the contacts S1 to S4 are opened. Similarly any damage to the monitoring circuit resulting in a break in the circuit may also be detected by the control circuit 1. Both these conditions will result in some form of alarm, usually audible, being operated.

The equipment shown in FIG. 1 can also be used to detect the closure of any normally open contacts S5 connected as shown between the detection and monitoring circuits. An example of such a device is a floor pressure mat, referred to above, which latter would usually possess normally open contacts.

One problem with the equipment shown in FIG. 1 is that, once one normally closed contact has been opened, the states of the remaining contacts cease to be monitored since there is no current flow. Furthermore, the monitoring circuit, if fitted, is an expensive and cumbersome adjunct which, whilst being extremely effective in high-security installations, can only increase the obstrusiveness of the wiring.

SUMMARY OF THE INVENTION

The object of the present invention is to enable these disadvantages to be overcome by providing across each pair of contacts in the equipment, whether they be of the normally open or normally closed type, a resistive element such as a resistor. The control circuit is operable to detect a change in current in the circuit, from one finite value to another, rather than detecting cessation or commencement of current as in known equipment. It will be seen that a separate monitoring circuit is unnecessary since any tampering with the main detection circuit, whether this results in a break or a short in the circuit, will result in a change of current which can be detected.

The security equipment of this invention can comprise combinations of normally-open and normally closed contacts all connected in series, in any order, around the detection circuit. It will be seen, therefore that this equipment is able to replace existing equipment whether this be operating largely with normally closed contacts (as with the equipment shown in FIG. 1) or largely with normally open contacts.

In a preferred embodiment of the invention, an additional resistive device, over those provided across the contacts, is provided at the furthest extremity of the detection circuit. The result of this is that the detection circuit always contains at least some resistance. This enables the control circuit to recognise, separately from current changes in the detection circuit, a short circuit resulting from accidental or deliberate damage to the wiring.

The control circuit is also designed to recognise the occurrence of an open circuit by detecting when the current flowing in the circuit falls below a predetermined low level.

The recognition of both a closed circuit or an open circuit by the control circuit is regarded as an alarm condition. Thus the ability of the equipment to recognise those extreme fault conditions maintains the high security of some existing systems without the need for a separate monitoring circuit.

The detector circuit can take many forms. In an embodiment of the invention, changes in the resistance of the detection circuit are used to control the operation of an oscillator whose output is connected, via a diode pump circuit, to a trigger circuit. Whilst the oscillator is running continuously, the output of the diode pump circuit inhibits the operation of the trigger circuit. As soon as the oscillator stops running, however, due to a change in detection circuit resistance the trigger circuit operates and an alarm is triggered.

BRIEF DESCRIPTION OF THE DRAWINGS

In order that the invention may be better understood, an embodiment thereof will now be described by way of example only and with reference to FIG. 1 is a block diagram of a prior art arrangement; of the accompanying drawings in which:

FIGS. 7 and 8 show details of portions of FIG. 6;

FIG. 11 shows the details of a normally open-circuit contact; and

DETAILED DESCRIPTION OF THE INVENTION

Figure 1:
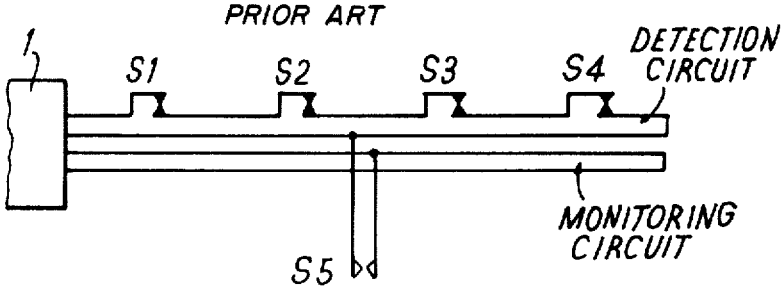
FIG. 1 PRIOR ART
Figure 2:
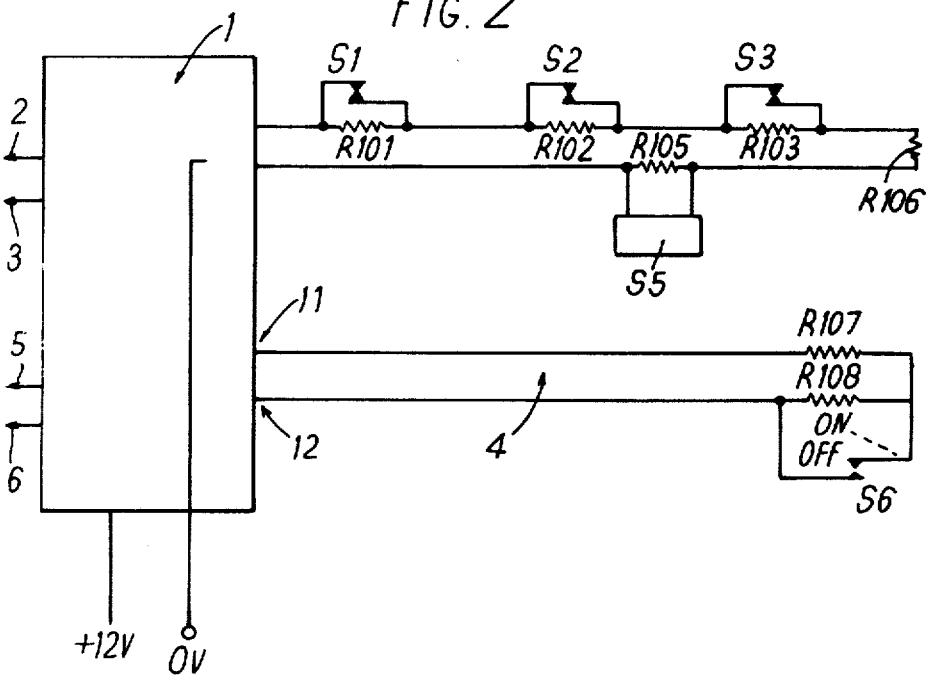
FIG. 2 shows, partly in block diagram form, one embodiment of the security equipment of this invention.
Figure 3:
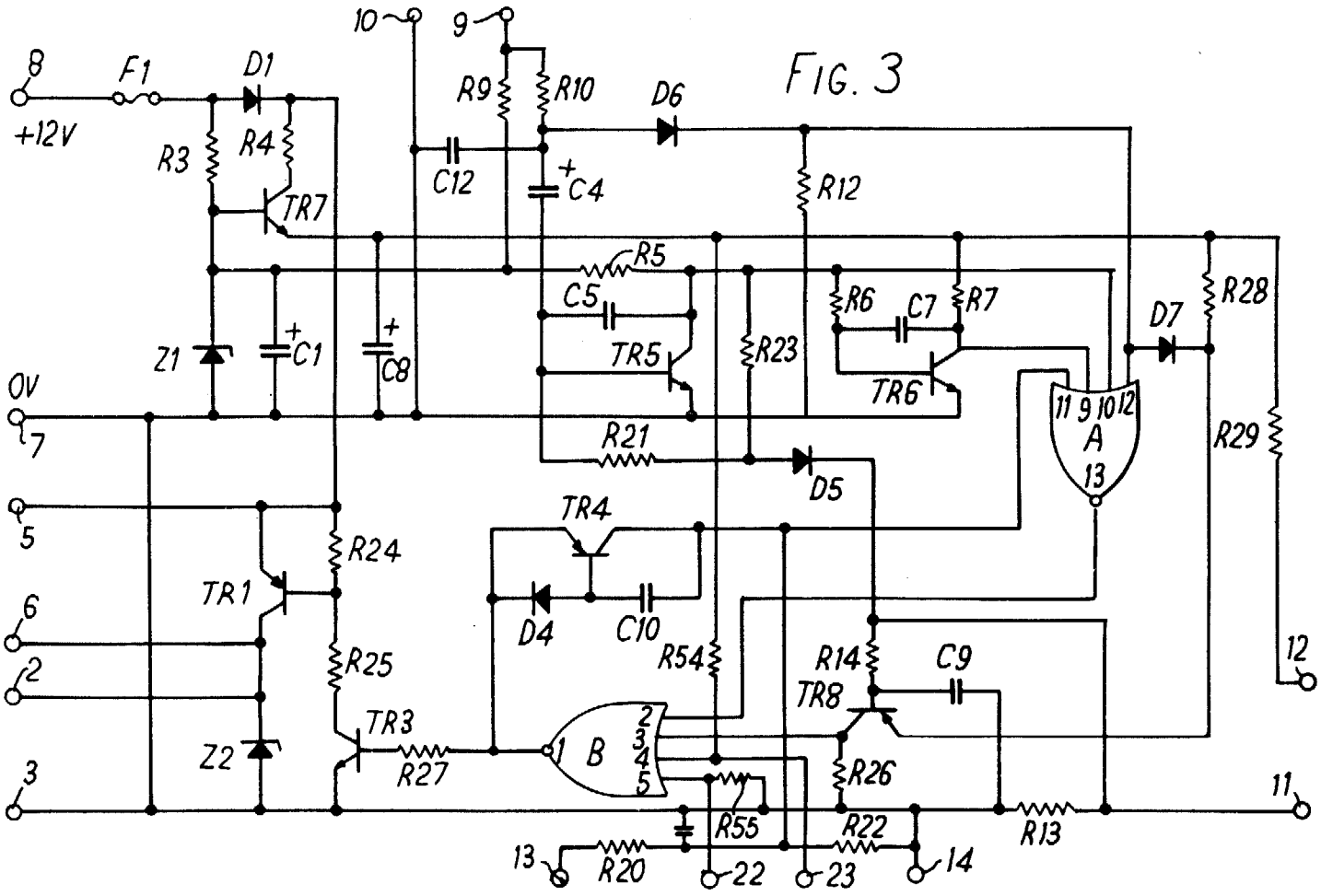
FIG. 3 is a circuit diagram of the control circuit used in the equipment of FIG. 2.

The security equipment shown in FIG. 2 is constructed in such a way that the control circuit can be housed within the case of a self-actuating bell. A self-actuating bell is one in which an alarm bell and its battery are housed inside a case. Any attempt to open the case operates an anti-tamper device which rings the bell. Usually, however, the bell is mounted in an inaccessible position to reduce the danger of tampering. The control circuit, to be described in detail with reference to FIG. 3, is intended to be powered from the internal battery, usually 12 volts, and, as such, is required to take only a very small current from the battery in its quiescent state.

Referring to FIG. 2, the security equipment comprises a detection circuit comprising a plurality of series connected normally-closed contacts S1 to S3, together with one normally-open contact S5 in the form of a floor pressure mat. Each pair of contacts S1 to S3 and S5 is connected in parallel with a respective resistor R101 to R103 and R105 respectively, and an additional resistor R106 is connected at the furthest extremity of the detection circuit in order to prevent the total resistance presented by the detection circuit in normal circumstances ever falling below a predetermined level. Each of resistors R101 to R103, R105 and R106 has, for convenience, an equal value and, in the particular embodiment illustrated, this is 3.3K Ω.

As explained above, each of the contacts S1 to S3 is mounted on a respective window or door of the premises to be protected. Opening of the door or window opens the respective contact S1 to S3 and results in a fall in the current flowing in the detection circuit. In a similar manner, pressure on the mat S5 closes its contacts and results in an increase in the current flowing in the detection circuit. Any change of current in the detection circuit is monitored in the control circuit 1 which in turn supplies an output to an alarm bell (not shown) at terminals 2, 3.

Since it is intended that the control circuit 1 be housed within the bell case, which latter is, as mentioned above, normally mounted in a fairly inaccessible position, a remote on/off switch is required.

In the embodiment illustrated, this takes the form of a separate switch circuit 4 which terminates in a normally closed switch S6. If desired, the switch S6 may be linked to the door lock of the main entry/exit doors of the premises. As this lock is opened or shut, so the alarm system is turned on or off.

The switch circuit 4 comprises two series connected resistors R107, R108, the latter of which may be selectively shorted by the switch S6. As will be explained later, the control circuit 1 is activated when a nominal current of 7.2 μA flows in the switch circuit 4, this corresponding to resistor R107 and R108 both being in circuit, and is off when the current is increased to 40 μA nominal corresponding to only resistor R107 being in circuit. To achieve this in the particular embodiment illustrated, R107 has a value of 33K Ω while R108 has a value of 560K Ω.

Terminals 5 and 6 of the control circuit 1 are intended for connection to an anti tamper switch for the bell case, referred to above.

The circuit of FIG. 2 may be modified by the provision of a multiposition circuit switching box (not shown). In some circumstances, it may be desired to divide up the doors and windows being protected into zones so that the security equipment can be activated to protect only part of the premises, the rest of the premises, perhaps, remaining in use. In order not to cause the alarm condition to become activated, it is necessary that, when switching only some and not all of the contacts into circuit, the current level be maintained as if all of the contacts and their parallel resistors were in circuit. Every normally open-circuit contact in the bypassed zone thus requires a corresponding resistor in the bypass to maintain the same overall detection circuit resistance and thus keep the same current flowing. The small interruption of current which occurs upon switching is of too short a duration for the control circuit to recognise and act upon it.

The multiposition circuit switching box described above can also be used as an alternative method of activating the alarm. To this end, the switching box is used to turn the control circuit 1 on or off via the switch circuit 4 by regarding the switch circuit 4 itself as a subdivision, the bypass of devices in this zone being effected by the door contacts S6.

The control circuit 1 used in the security equipment of FIG. 2 will now be described with reference to FIG. 3.

Power is taken from a 12 volt battery (not shown) within the bell case and is applied to power supply terminals 7 and 8. Diode D1 ensures that reversal of battery polarity will not damage the circuit. The bell drive circuitry, comprising transistors TR1, and TR3, operates directly from the 12 volt supply. For the remainder of the circuit, a regulator including a dropper resistor R3 together with a zener diode Z1 and reservoir capacitor C1 ensure a first smooth D.C. supply of 5.3 volts. This first supply acts as a reference voltage for an emitter follower transistor TR7 which provides a second supply having a larger current capacity than that available just through resistor R3. The emitter voltage of transistor TR7 is stabilized at 4.7 volts and is protected from excessive current by resistor R4. The detection circuit, shown in FIG. 2, is connected to terminals 9 and 10 and controls the input of an amplifier comprising transistors TR5 and TR6. The normal current through the detection circuit is maintained from the 5.3 volt supply rail via a resistor R9. A mains frequency filter is formed by resistors R10, R5 and capacitor C5, making with transistor TR5 an active filter of the integrating type. Any change in the resistance between terminals 9 and 10 results in a step change of D.C. voltage at the terminal 9, which change in voltage is transmitted through a capacitor C4 and so to the base input of transistor TR5. This perturbation is only temporary, up to about 1 second only, since the voltage at the junction of resistors R9 and R10 is fairly quickly restored by the charging of capacitor C4 through resistors R21, R23, R5 with a time constant of about 1.5 seconds. These perturbations in the otherwise steady circuit voltages are the means by which the remainder of the circuit detects an alarm condition.

The circuit basically comprises three parts: an amplifier, as already mentioned comprising transistors TR5 and TR6; a monostable circuit comprising a pair of 4-input NOR gates A and B; and a bell drive circuit comprising transistors TR1 and TR3.

Logic gate A is ½ of a CMOS integrated circuit type MC14002B and logic gate B is the other ½ of the CMOS integrated circuit type MC14002B. The switching thresholds of both gates are nominally mid-way between their supply rails at 0 V and 4.7 V respectively. Transistor TR5 is type BC239C and is essentially of high current gain, typically 400 to 800, and preferably of low noise. Transistor TR6 is general purpose type BC238.

The purpose of the amplifier is to convert the tiny perturbations in voltage at terminal 9 into large enough changes to operate logic gate A reliably. In the normal energised condition of the circuit, all the inputs of gate A are at logic 0 and the output of the gate is at logic 1. When any one input changes to logic 1, the output of gate A changes from logic 1 to logic 0, thus setting the monostable. Input pins 9 and 10 of gate A are connected to respective outputs of the amplifier, input pin 12 will be mentioned below, and input pin 11 is a positive feedback input to form gates A and B into the monostable.

Transistor TR5 is biased in an amplifying mode by resistors R21 and R23 which supply base current from the collector. The inherent negative feedback of this arrangement stabilizes the collector to a voltage of 1 to 1.5 volts which is below the threshold of gate A, which thus normally remains at logic 0. Any negative going voltage perturbations at terminal 9 cause the potential at the collector of transistor TR5 to rise and exceed the threshold of gate A so that its input 10 changes to logic 1.

Transistor TR6 is biased on by the current through a resistor R6 from the stabilized collector voltage of transistor TR5. Its collector voltage is thus very close to 0. volts, causing input 9 of gate A to normally remain at logic 0. Any positive going perturbation at terminal 9 reduces the collector voltage of transistor TR5 to zero which in turn removes the base supply current of transistor TR6. Thus transistor TR6 turns off, and its collector voltage rises through resistor R7 to exceed the input threshold of gate A, and thus apply logic 1 at input 9.

In this way any positive or negative perturbation at terminal 9 results in gate A changing its output state from logic 1 to logic 0 thus causing the monostable formed by gates A and B to set and generating an alarm condition. The integrating action of capacitors C5 and C7 connected across the base/collector junctions of transistors TR5 and TR6 respectively ensures that mains frequency pickup and other spurious voltages induced into the detection circuit are ignored.

It will also be seen that short circuits in the detection circuit can be detected by the fall in resistance which occurs when the resistor R106 (FIG. 2) is shorted. This results in a fall in resistance of the detection circuit from the resistance of resistor R106 to zero or near-zero and would thus manifest itself at the terminals 9 and 10 as a negative-going perturbation resulting in an alarm condition.

It has been explained that perturbations in the amplifier allow the voltage on either input 9 or 10 of gate A to rise towards the 4.7 volt supply through resistors R5 or R7 respectively. Once the switching threshold of input 9 or 10 of gate A is exceeded, the output 13 of gate A goes to logic 0, which causes the output of gate B to go to logic 1. This is assuming that the commoned inputs 3, 4 and 5 of gate B are at logic 0, as will be explained later.

The logic 1 at output pin 1 of gate B is transmitted back to input pin 11 of gate A via a duration delay circuit comprising transistor TR4 of general purpose type BC308, thus setting the monostable. The alarm condition is possible only when the monostable is set. The monostable remains set, irrespective of the subsequent state of inputs 9 or 10 of gate A, until cleared by input 11 of gate A going to logic 0, and the manner in which this is achieved will now be explained.

The duration delay circuit comprises transistor TR4, capacitor C10 and diode D4 and is operable to maintain the positive feedback of the monostable for a predetermined period of time, usually 20 minutes, and then to apply a logic 0 to the input 11 of gate A to clear the monostable. It is to be assumed that the terminals 13 and 14 will not normally be connected together. The purpose of these terminals will be explained hereinafter.

The delay circuit operates as follows:

It has already been mentioned that, when the monostable becomes set, a logic 1 appears at the output 1 of gate B. The step rise in potential from logic 0 to logic 1 at this time causes diode D4 to become reverse biassed, and timing capacitor C10, normally discharged with logic 0 level at both its terminals, suddenly has the logic 1 potential of 4.7 volts applied to both its terminals. The capacitor thus starts to slowly charge via resistor R22. Resistor R22 is a high-value resistor, for example of 33 MΩ, and its lower end is strapped to the common rail (logic 0).

As capacitor C10 charges, the potential at input 11 of gate A falls, and eventually the switching threshold of about 2.4 volts will be reached, thus switching input 11 to logic 0 and clearing the monostable. The time that the monostable remains in the set condition is governed by the charging time of timing capacitor C10. It is to be noted that the voltages quoted above are given by way of example to illustrate the operation of the circuit.

Once the monostable has cleared, the output 1 of gate B reverts to logic 0 and capacitor C10 discharges through the substrate diode inside logic gate A on input 11 and diode D4.

In the foregoing, it has been assumed that the terminals 13 and 14 are not shorted together, thus leaving timing resistor R20 out of circuit. When the terminals are so shorted, timing is dependent upon the much smaller resistor R20, having a delay of typically 7 seconds, which can thus be used for testing purposes.

Should the detection circuit become open circuit, the potential at terminal 9 rises and a diode D6 connected from the junction of resistor R10 and capacitor C4 transmits this rise to the input 12 of logic gate A so that its threshold is exceeded, thus applying logic 1 to input 12. Thus the monostable is set because of the logic 1 at input 12 and an alarm condition is generated. Since this logic 1 is constant, the monostable is unable to clear and the alarm condition is not timed and continues indefinitely. This covers the situation where an intruder has severed a conductor in the detection circuit effecting an open circuit.

Whatever the cause, the effect of a logic 1 output on terminal 1 of gate B will normally be to make transistor TR3 switch on. The collector of transistor TR3 thus falls to zero volts thereby sinking current through resistors R24 and R25 which has the effect of turning on transitor TR1 to actuate the bell (not shown) connected across terminals 2 and 3. Protection of power transistor TR1 from high voltage spikes due to inductive loads is provided by a 15 volt zener diode Z2.

Protection from excessive dissipation to TR1 due to accidental shorting of the terminals 2 and 3 is provided by fuse F1 connected in the positive supply path from terminal 8.

The bell drive circuit draws virtually no current until the bell is required to ring. This is an important feature since the circuit is intended to be run from a dry battery. Capacitors C6, C12, C9 are to suppress R.F.I. when the bell rings, thus preventing malfunction of the circuit. Also, they reduce susceptibility of the circuit to externally generated R.F.I.

The switch circuit, for remote activation of the control circuit, is connected across terminals 11 and 12. It will be recalled that this circuit comprises two series connected resistors, one of 560 KΩ and one of 33 KΩ in which the 560 KΩ resistor can be selectively shorted out by means of a switch (see FIG. 2).

The control circuit is arranged so that, if the resistance of the switch circuit between terminals 11 and 12 lies between zero and approximately 10 KΩ, the alarm condition is generated. In this state, a relatively heavy current is drawn through the switch circuit and through a resistor R13 connecting terminal 11 to the OV supply rail and the potential at terminal 11 is thus high. This potential, transferred via a resistor R14 to the base of a transistor TR8 is too high to enable its base/emitter junction to conduct. Transistor TR8 is a PNP general purpose type BC 308. Transistor TR8 is thus turned off, allowing input 3 of gate B to be maintained at logic 0 thereby keeping the gate open. Also, the emitter of transistor TR8 is close to the 4.7 volt supply rail since its emitter resistor R28 has only a tiny current through it due to resistor R12 which connects to 0 volts via diode D7. Hence, input 12 of gate A is also high at logic 1 and the monostable is set. The latter is not able to clear with this range of resistance values between terminals 11 and 12, since input pin 12 of gate A constantly is logic 1. The alarm condition thus generated is not timed and continues indefinitely. This is the situation where the switch circuit is tampered with by an intruder who effects a short circuit.

In a similar way, if the resistance of the switch circuit between terminals 11 and 12 is greater than approximately 2 MΩ, the alarm condition is generated. In this state, the now low potential at terminal 11 is transferred via diode D5 to the junction of resistors R21 and R23 to starve transistor TR5 of base current. This sends its collector voltage up to the level of the 5.3 volt zener rail setting the monostable via input 10 of gate A which is now at logic 1. As previously, also with this range of resistance values between terminals 11 and 12, the monostable is not able to clear since input 10 is constantly at logic 1. The alarm condition thus generated is not timed and continues indefinitely. This is the situation when the switch circuit is tampered with by an intruder who severs a conductor to effect an open circuit.

The range of switch circuit resistance which lies between 15 KΩ and 1 MΩ corresponds to the normal on and off conditions of the control circuit, as will now be explained.

When the switch circuit resistance lies between 80 KΩ and 1 MΩ, the control circuit is in the ON state and the amplifier and monostable are allowed to function normally (subject, of course, to any perturbations due to changes of current in the detection circuit). Under these conditions the potential at terminal 11 is insufficient either to allow input 12 of gate A to reach logic 1 level, via transistor TR8 which is conducting and diode D7, nor to allow input 3 of gate B to reach logic 1 level. Hence the monostable is not set but is in readiness to be set by the amplifier, with gate B in the open position.

If the resistance of the switch circuit lies between approximately 15 KΩ and 50 KΩ, then the potential transferred via resistor R14 from terminal 11 is higher than the 2.4 volts switching threshold of the gate B and the input 3 thus goes to logic 1, since the potential under these conditions is lower than the 3.75 volts necessary to switch off the transistor TR8. Thus, the output 1 of gate B will be a logic 0 and transistor TR3 remains switched off. The bell therefore remains silent. This is the OFF state of the control circuit and whatever the condition of the detection circuit no alarm condition can be generated.

Both detection circuit and switch circuit are protected against damage due to the accidental application of a high voltage by means of resistors R10, R29 and R14 which limit any potentially damaging current to a safe value in most situations. Resistor R29 also prevents power to circuit 1 being completely removed through a short circuit occurring between terminals 12 and 10. This would prevent the alarm condition occurring when the premises wiring has been tampered with.

In the foregoing, it is assumed that inputs 4 and 5 of gate B (FIG. 3) are both at logic 0. In fact, input 5 is held at logic 0 via resistor R55 but input 4 would rise to logic 1 through resistor R54 were it not for the fact that terminal 23 is normally taken to 0 volts by means external to FIG. 3. If either input pin 4 or 5 rises to logic 1, then the bell cannot ring. Terminals 22 and 23, therefore, are used as additional means of silencing the bell.

In order to maintain the high security of the equipment, the only wiring allowed to leave the housing containing control circuit 1 is either the detection circuit or the switch circuit or a conventional four-wire cable containing a pair of conductors carrying the information and a pair of conductors for monitoring purposes only. If the latter are short circuited or open circuited an alarm condition is generated. The self-monitoring ability of both the detection circuit and the switch circuit has already been described. However, terminals 22 and 23 are not self-monitoring. The security of the system is reduced if they are taken outside the housing of control circuit 1. In the applications to follow all electrical connections apart from four-wire monitored cables or self-monitoring conductor pairs must be housed in the same anti-tamper protected housing to maintain the high security of the equipment. Where these applications involve manual switches, this implies that the housing is positioned in some accessible place in the premises yet also in a protected area.

Figure 4:
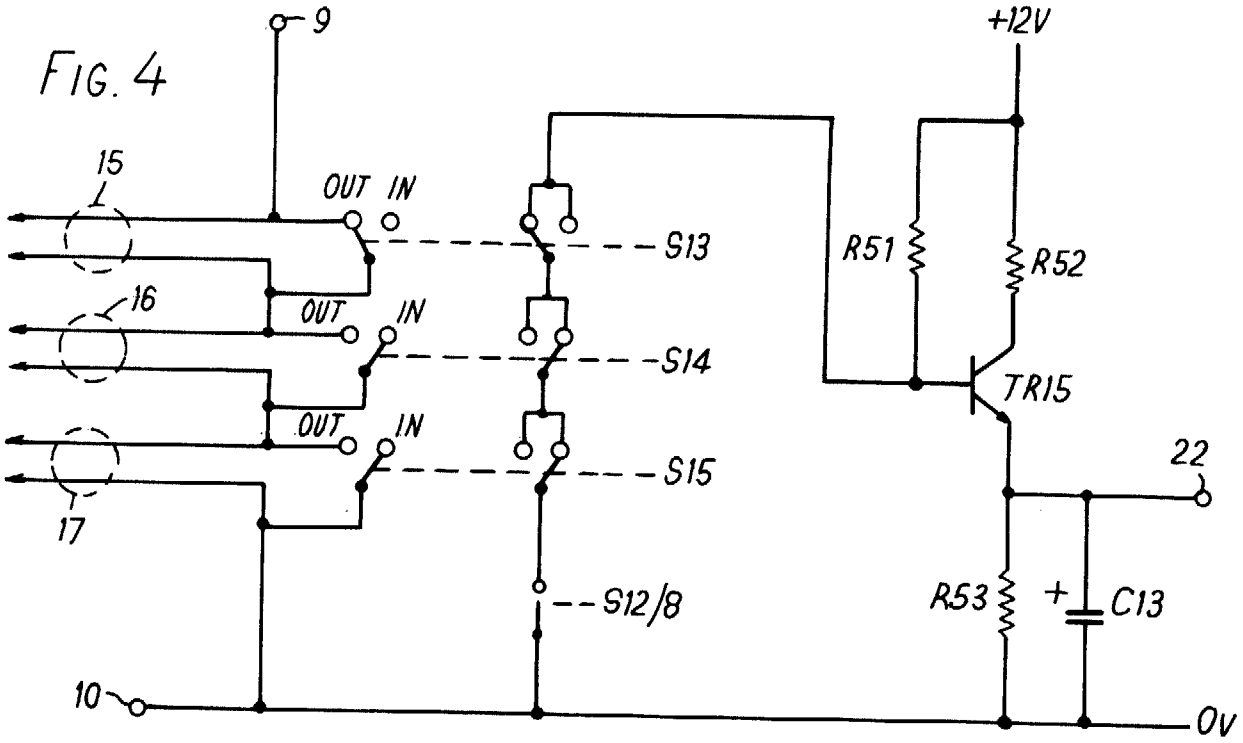
FIG. 4 is a circuit diagram of a modified arrangement to prevent an alarm condition when switching a partial zone out of circuit.

It has already been mentioned that the protected area may be divided up into zones so that the security equipment may only protect part of the premises as desired from time to time. In the foregoing arrangement, a bypass resistor was used to ensure that the same current flowing through the detection circuit was maintained to prevent an alarm condition being generated whilst switching a zone out of circuit. FIG. 4 shows, by way of example an alternative method.

Three zones are shown under references 15, 16 and 17, each zone having a respective detection circuit. Zone 17 is shown switched into circuit by double pole break-before-make switch S15, zone 16 is also shown switched in by a similar switch S14 and zone 15 is shown switched out by another similar switch S13. The detection circuits 15, 16 and 17 of each zone are (when in circuit) wired in series and are connected to terminals 9 and 10 of FIG. 3. When a zone is to be unprotected it is shorted out by its respective switch. The resulting current change in the series-connected detection circuits is prevented from generating an alarm condition for a period of 30 seconds after any zone switch has been altered.

Switch S12/8 is shown closed and will be mentioned later. Terminal 22 of FIG. 4 connects to terminal 22 of FIG. 3 and so also do the OV and +12 v respectively of FIGS. 3 and 4 interconnect. Normally, terminal 22 is at logic 0 by virtue of the action of an emitter resistor R53 keeping parallel capacitor C13 in a discharged state and so controls the circuit 1 if FIG. 3 operates as above described. However, when a zone switch is operated, the 0 volt connection to the base of transistor TR15 is momentarily removed to allow the base to rise positively through resistor R51. Transistor TR15 is a BC238, NPN general purpose transistor in the emitter follower configuration. Resistor R52 limits the collector current to a safe value in operation. The momentary rise in base voltage quickly causes capacitor C13 to become charged to 5.3 volts. Thus, when the zone switching is complete the base-emitter junction becomes reversed biased because the base of the transistor is at 0 volts and the emitter at 5.3 volts. Capacitor C13 now slowly discharges through resistor R53 and also through resistor R55 of FIG. 3. Capacitor C13 takes about 30 seconds to discharge below the logic threshold of input pin 5 of gate B and during this period of time no perturbations in the detection circuit will generate an alarm condition. By the end of this period the amplifier has re-adjusted itself to the new detection circuit current brought about by switching a zone in or out of the detection circuit. Control circuit 1 is once again able to generate an alarm condition from a perturbation in the detection circuit.

Figure 5:
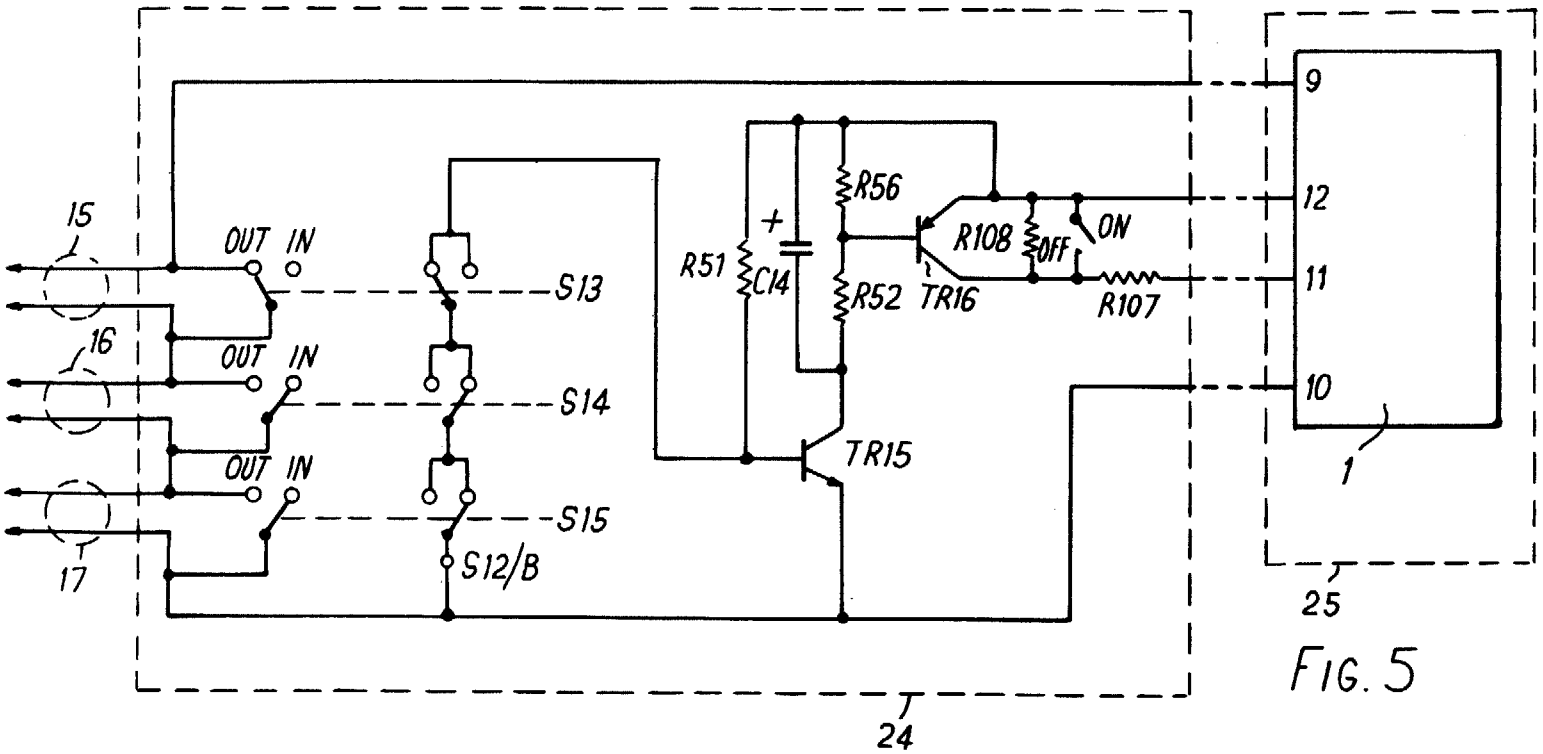
FIG. 5 is a circuit diagram of a modification of FIG. 4.

FIG. 5 shows a variation of the circuit of FIG. 4 where the ON-OFF switch and the zone switching are housed separately in a housing 24 to control circuit 1 housed in a housing 25. The intercorrections between the equipments are solely from terminals 9, 10, 11 and 12, both pairs of which are self-monitoring. Hence transistor TR15 operates in the common-emitter mode and switching a zone out causes its collector voltage to fall from 4.7 volts to 0 volts. Capacitor C14 quickly charges turning on the PNP transistor TR16 (type BC308) through resistor R52. Transistor TR16 shorts out resistor R108 to put the control circuit 1 in the OFF condition, and thus prevent the bell sounding. When capacitor C14 is fully discharged through resistors R52 and R56, transistor TR16 turns off and control circuit 1 becomes ON again. This takes about 30 seconds which allows the detection circuit to re-adjust to the new value of current.

It has been already explained that the advantage of this system over conventional wired security systems is that the premises are still protected, albeit at a slightly reduced level of security, when one or more contacts are not in their normal state. However, it is an advantage to know whether or not all the contacts are in their normal state. The simplest method would be to measure the resistance of the detection circuit and compare it with the known resistance when all contacts are in their normal state. However, if the number of normally open-circuit contacts that were closed equalled the number of normally closed-circuit contacts that were open then for every 3.3 KΩ that had shorted there would be another 3.3 KΩ resistor added in circuit. The detection circuit resistance could thus equal the known normal detection circuit resistance even if some contacts were not in their normal state.

A solution to this problem is to distinguish between normally open-circuit contacts and normally closed-circuit contacts. For example, all the normally open-circuit contacts e.g. mats, are wired together in series and brought back to the control circuit separately from the normally closed-circuit contacts. An additional feature not shown in FIG. 3, enables a push button check to be made to see whether any of these normally open-circuited contacts are in fact closed. The total resistance actually in circuit is compared to the known total if all these contacts are open. If the actual resistance is lower by about 3.3 K ohms or greater, then at least one contact is closed already. A fault lamp will illuminate to warn the operator of this condition. Control circuit 1 will still protect the premises, being self adjusting, but the operator has been made aware that one normally open-circuit contact is likely to be non-operative unless found and corrected.

A more sophisticated approach follows. Since the voltage across the 3.3 K ohms resistor across a normally open-circuit contact lies between 60 and 100 millivolts a 1N914 silicon diode placed in parallel across each one in the forward direction of current will not affect the operation of control circuit 1, the voltage being insufficient to reach the onset of conduction of the diode. Suppose that every zone has a 3.3 K ohm resistor at its furthest extremity which also has a diode in parallel with it. Then, if the number of normally open-circuit contacts in the detection circuit is P and if the voltage across the diodes when conducting is 0.65 volts and if a test current of 7 milliamps is passed through the zone, a voltage of 0.65 (P+1) volts will appear across the zone detection circuit. There will be no voltage across the normally closed-circuit contacts and the wiring resistance has been ignored. Obviously, to avoid generating an alarm condition whilst this test is carried out, control circuit 1 must be put into the OFF state.

This zone test voltage is compared with a reference voltage appearing across a dummy zone circuit due to an identical 7mA current source passed through it. If both voltages are within 0.3 volts of each other, to allow for component tolerances and temperature variations, then all the contacts within this zone are deemed to be in a normal state. If one or more normally open-circuit contact is closed, or the resistor at the furthest extremity of the zone is short circuit then the zone test voltage will be 0.65 volts or more short of the correct value. The comparison turns on a fault indicator. If one or more of the normally closed-circuit contacts is open, then the zone test voltage will exceed the correct value by, theoretically, $7\times3.3=23.1$ volts or more. In practice the voltage is limited to a safe value by diverting the applied current into the fault indicator in this case.

FIG. 11 shows the arrangement of a normally open-circuit contact with its resistor and diodes. Two diodes wired in reverse parallel are used to ease installation. One diode is always reverse biased. The installer may wire the contact either way round and the effect in the circuit will be the same. Resistor R63 is 3.3 K ohms and diodes D11 and D12 are types 1N914.

Figure 6:
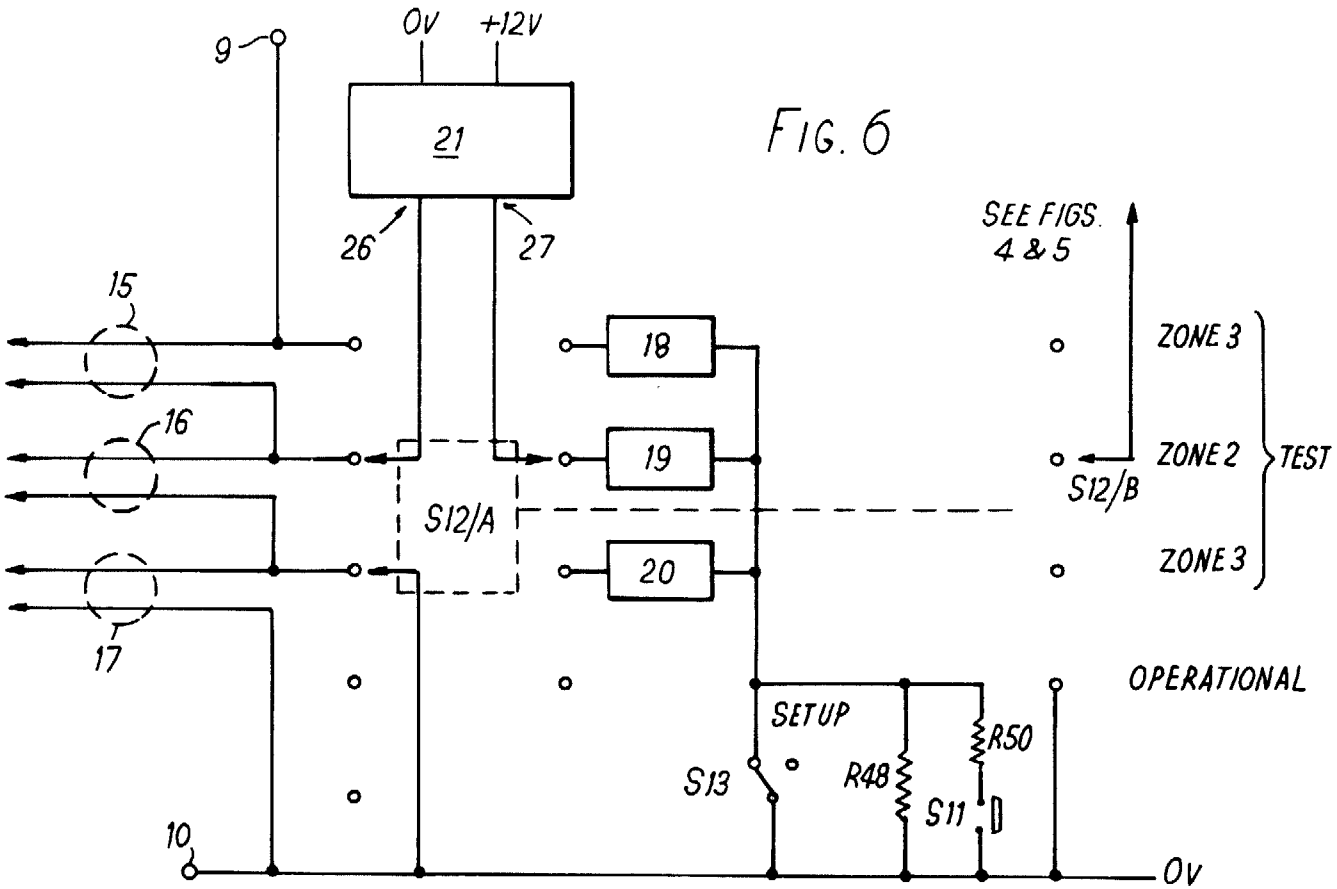
FIG. 6 is a circuit diagram of another modification of FIG. 4.

FIG. 6 shows an example of this approach using three zones 15, 16 and 17. The terminals 9, 10 and OV and +12v are connected to the same terminals of control circuit 1. Dummy zone circuits for 15, 16 and 17 are numbered respectively 18, 19 and 20. A pair of identical current sources emanate at outputs 26 and 27 of a dual constant current source 21. Switch S12 consists of three contacts at section S12/A in the fixed configuration shown and a further contact section S12/B which moves together with those at section S12/A from the positions zone 3, zone 2 etc, through to OPERATIONAL (movement of switch S12 is a vertical movement in the drawing). In the latter (OPERATIONAL) position, the contact of switch section S12/B is held at logic 0 (0 volts) so that control circuit 1 is allowed to be in the ON state. Switch section S12/B connects either into the circuits of FIG. 4 or FIG. 5. The remaining contacts of section S12/A are disconnected so that no current flows out of outputs 26 or 27.

With switch S12 in the position shown, zone 16 is tied to 0 volts and output 26 feeds current through it. At the same time, output 27 feeds current into the dummy zone circuit 19. The test comparison takes place in source 21. Note that switch S13 is closed, except for setting up the dummy zone circuits and that switch contact section S12/B, not being grounded to logic 0 any more, turns OFF control circuit 1 to prevent an alarm condition being generated. When switch S12 is returned to the OPERATIONAL position it takes 30 seconds before control circuit 1 goes into the ON state as described in FIGS. 4 and 5.

FIG. 7 shows the internal circuitry of the dual current source 21. A stable coltage is developed across a 5.6 volt zener diode Z10, type BZX79, being fed by a series resistor R41. The command bases of general purpose transistors BC308 TR10 and TR11 are held 1 volt lower than the +12 volt supply by means of a potential divider comprising resistors R42 and R43. Negative feedback caused by resistors R44 and R45 in the emitters of these transistors stabilizes their collector currents at 7mA despite variations in temperature and supply voltage fluctuation.

Transistors TR12 and TR13, also type BC308 compare the voltages at outputs 26 and 27. Under test conditions, if output 26 is lower by 0.65 volts or more, then transistor TR12 conducts and diverts part of the current from source 27 into light emitting diode LED 1. This diode thus illuminates to show that a normally open-circuit contact is closed or the resistor at the furthest extremity is shorted. Alternatively, if output 26 is at a higher voltage than output 27, transistor TR13 conducts to divert all of the available current into light emitting diode LED 2. This diode thus illuminates to show that a normally closed-circuit contact is open.

When more than one kind of contact is faulty, the normally closed-circuit fault indicator illuminates only. When these have been repaired the normally open-circuit indicator then illuminates.

FIG. 8 shows the circuit of the dummy zones 18, 19 and 20. The temperature coefficient of transistor TR14 approximates closely to that of multiple diodes in series in the zone detection circuit and resistors R46 and R47 match the series connected 3.3 K ohm resistors. Resistor R46 is adjustable to allow the matching of the onset of conduction between the group of series diodes and the transistor TR14.

To set up resistor R46 for a particular zone, switch S13 (FIG. 6) is switched to the SET UP position and the contacts in the zone are in their normal position. The current through resistor R48 allows output 27 to be slightly more positive and resistor R46 is adjusted till LED 1 just illuminates. Push switch S11 (FIG. 6) is then depressed to check the LED 1 will extinguish. The last two operations are repeated to obtain the correct result. Finally, the switch S13 is closed to remove the boosted voltage of output 27. This procedure enables a closely defined voltage margin to be set up on the test comparison to prevent a fault being erroneously indicated due to adverse temperature drift of the components.

Figure 9:
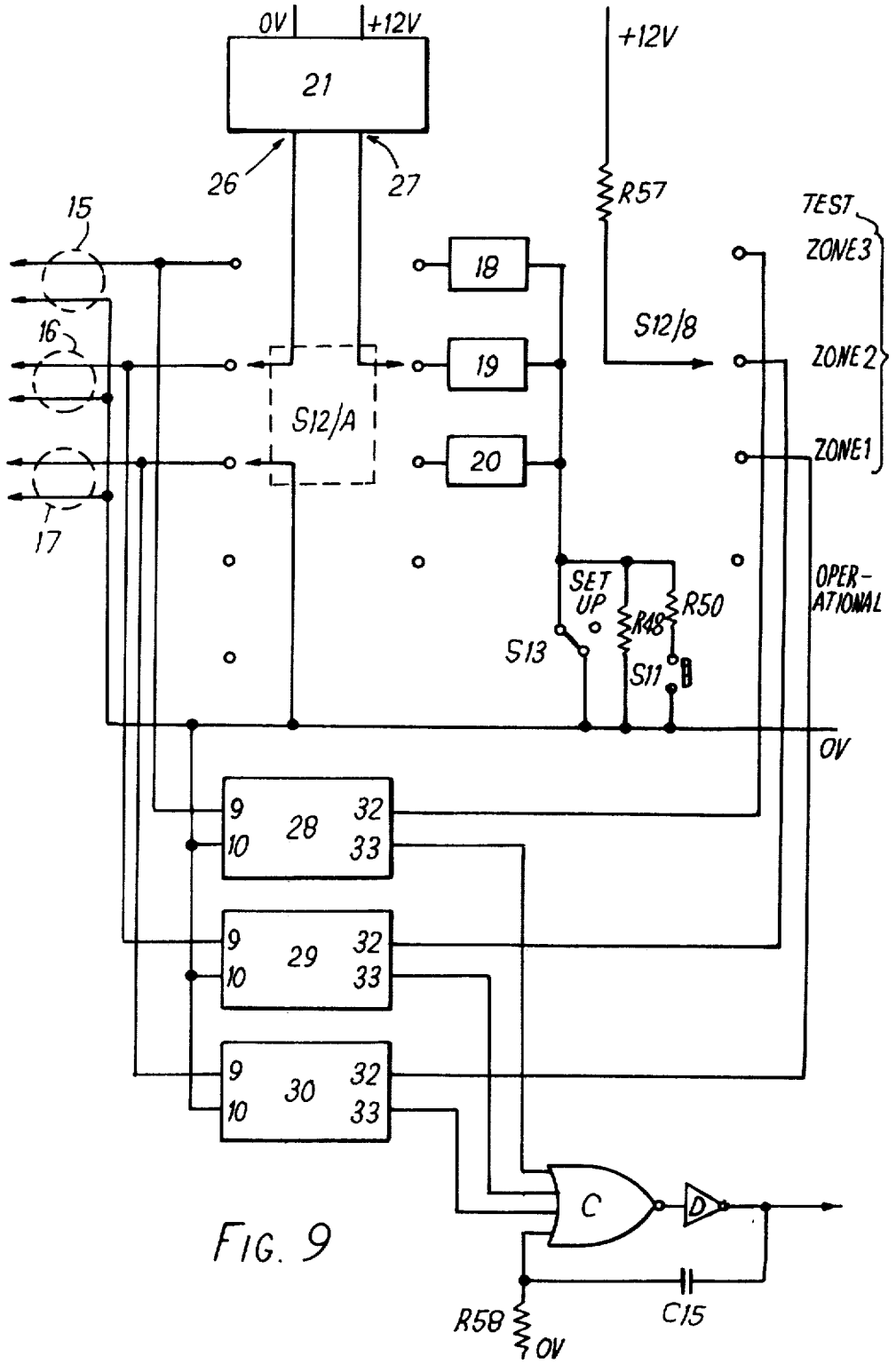
FIG. 9 is a circuit diagram of an alternative application of the invention to more than one zone.

An alternative application of the invention when there is more than one zone is shown in FIG. 9. In these examples of switched zones there may of course be any reasonable numbers of zones from one upwards. The control circuit 1 can accommodate a maximum of thirty 3.3K ohm resistors and so, although there is no theoretical limit to the number of normally closed-circuit contacts, there is an upper limit to the number of normally open-circuit contacts: twenty-nine plus one resistor at the furthest extremity. FIG. 9 shows an arrangement whereby the limit of twenty-nine normally open-circuit contacts applies to each zone only, and not to the whole system as in the circuit of FIGS. 5 and 6.

A similar circuit to control circuit 1 appears under each of reference numerals 28, 29 and 30, and is detailed in FIG. 10 described later. Each zone has its own input terminals 9 and 10 and output terminal 33. Terminal 32 is an inhibit terminal so that no alarm condition is generated when switching a zone in or out nor when testing a zone. Resistor R57 limits the current into the inhibit terminal to a safe value. A pulse output at terminal 33 occurs when a perturbation occurs in a zone that is switched in, and gates C and D with resistor R58 and capacitor C15 from a 20 minute alarm period, by way of example. A logic 1 at output 31 is arranged to operate the bell, not shown.

Figure 10:
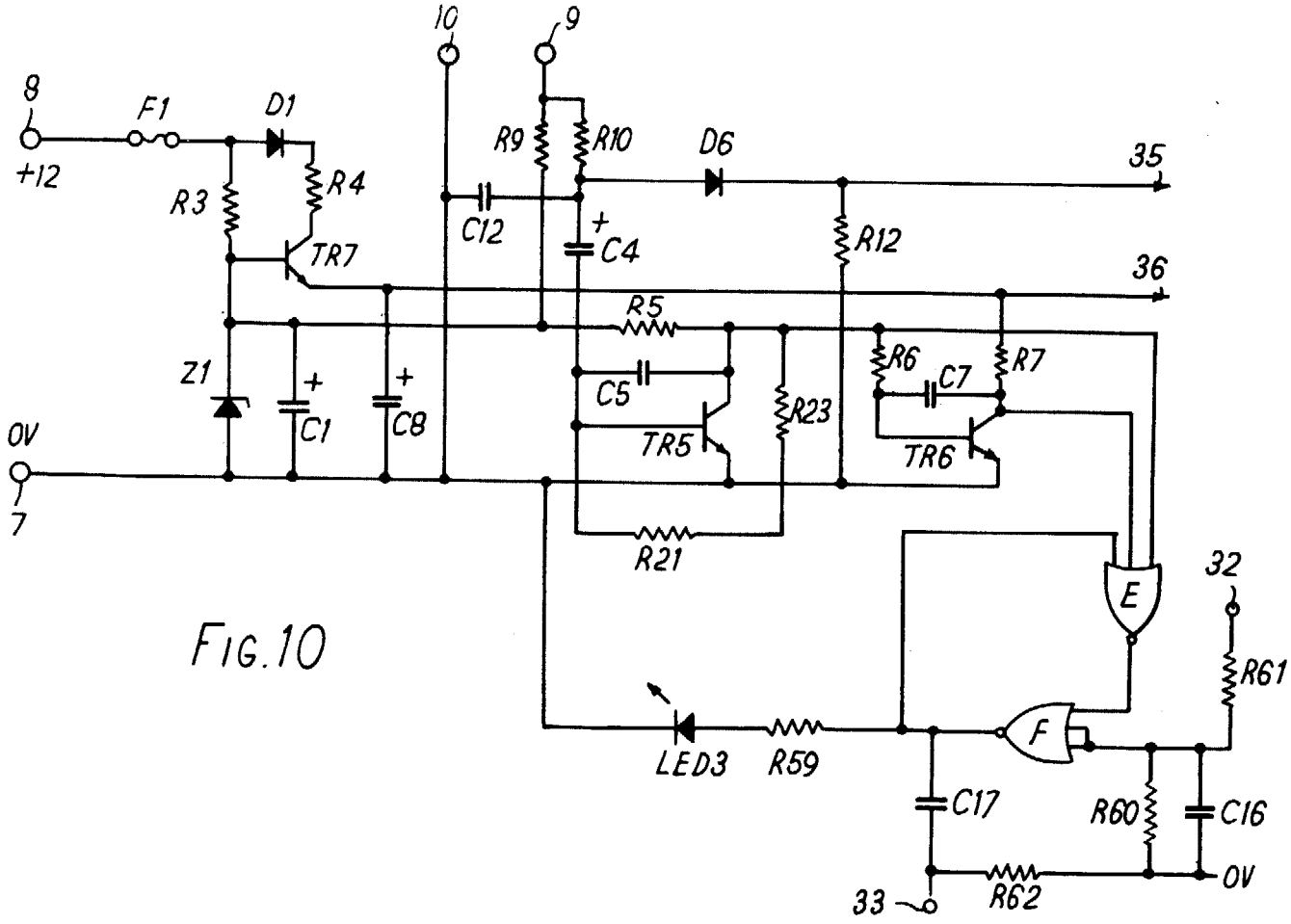
FIG. 10 is a circuit diagram of an individual zone.

FIG. 10 operates similarly to control circuit 1 and detailed explanation will therefore not be given. However, the amplifier outputs enter separate inputs of a NOR gate E, type MC14025, and thereby to a NOR gate F of the same type. Gates E and F together form a bistable circuit. Any perturbations in voltage between terminals 9 and 10 set the bistable and LED 3 illuminates showing that a perturbation has been detected. Capacitor C17 together with resistor R62 provide a differentiated positive pulse output at terminal 33. The bistable is reset, or prevented from setting by the other inputs to gate F being at logic 1. Resistor R61 limits the flow of current into capacitor C16 to a safe value and the time constant of resistor R60 and capacitor C16 taken together is about 30 seconds. It takes this time period after the reset voltage of logic 1 has been removed from terminal 32 before any perturbations can set the bistable. This allows the amplifier time to settle down with the present state of its zone detection circuit. Terminal 35 is connected to equipment, not shown, to record an open circuit in the zone detection circuit and terminal 36 is a 4.7 volt supply terminal to be used by further logic and amplifiers, not shown.

FIG. 9 thus shows how zones can be switched in or out or tested using a digital inhibit into terminal 32, which can be achieved without reducing the security protection in other zones. FIG. 9 also shows how, by using an individual circuit of FIG. 10 for one particular zone the characteristics of that zone can be specially arranged leaving the other zones to operate in the manner previously described. An example of this is where one zone is defined specifically for entry and exit of the protected area. A time delay of, say, 30 seconds can be allowed on exit before any perturbations are allowed to generate an alarm condition, and similarly on entry. This gives the operator time to leave the premises without setting the alarm and time to switch his zone out on entry before setting the alarm.

Although it has been assumed above that the switch contacts in the detection circuit are of the simple mechanical type for operation in conjunction with the doors and windows etc of the premises, it is of course possible to use ultrasonic, microwave and infrared ray intruder detectors whose output is a switch means which may be connected in the detection circuit.

Figure 12:
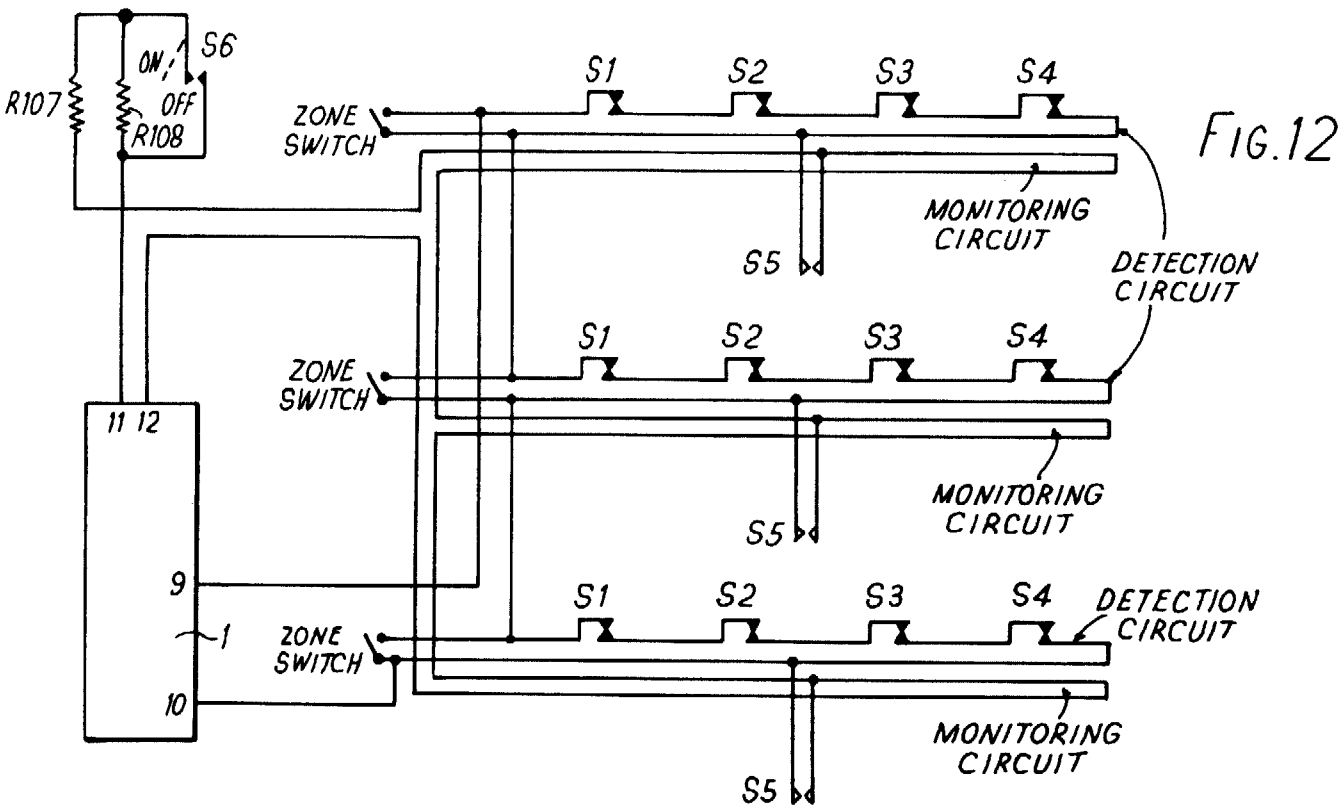
FIG. 12 is a circuit diagram of modified security equipment.

The switch circuit described above may be used as a monitoring circuit in a conventional four-wire security system of the type described in FIG. 11. If there is a short circuit between any part of the detection circuit and any part of the switch circuit then an alarm condition is generated. Depending upon the location of the short circuit in the wired premises, the bell may sound for 20 minutes only or indefinitely. This facility means that premises already installed with a four-wire system with normally open circuit contacts placed across the detection and monitoring circuits can be fitted with control circuit 1. It is customary to wire mats and panic buttons in this manner. FIG. 12 shows an example of this application where the switch circuit of FIG. 2 is used as the monitoring circuit.

Control circuit 1 may also be housed inside the premises. It is not essential for it to be placed inside a bell housing.

I claim:

1. Security equipment comprising a detection circuit including a plurality of individual interconnected switch means adapted to be distributed about a premises to be guarded, each of said switch means having a resistance element connected thereacross so that operation of the respective switch means results in a change in the current flowing in said detection circuit, and a central control unit to which said detection circuit is connected, said control unit including an alarm, a trigger circuit connected to said detection circuit such that a change in said detection circuit corresponding to operation of one of said switch means results in the output from said trigger circuit rising from a quiescent level to a predetermined trigger level, an alarm circuit connected to the output of said trigger circuit and operable to energize said alarm whenever the output from said trigger circuit rises to said predetermined trigger level, and means for restoring the output of said trigger circuit to said quiescent level after a current change has occurred so that any subsequent current changes in said detection circuit are still able to trigger said alarm circuit.

2. Security equipment as claimed in claim 1, further comprising a switch circuit including switch means for controlling the operation of said central control unit.

3. Security equipment as claimed in claim 2, wherein said switch means of said switch circuit has a resistance element connected thereacross so that operation of said switch means results in a change of current flowing in said switch circuit.

4. Security equipment as claimed in claims 2 or 3, wherein said central control unit further includes means for detecting when the resistance of said switch circuit takes up a value above or below a predetermined range and for actuating said alarm in such event.

5. Security equipment as claimed in claims 1, 2 or 3, wherein said detection circuit includes at least one further resistance element which is not associated with said switch means, such further resistance element being connected such that, in normal operation, the circuit always possesses at least some resistance.

6. Security equipment as claimed in claim 5, wherein said central control unit includes a further detecting means for detecting a short circuit condition in said detection circuit and for actuating said alarm in such event.

7. Security equipment as claimed in claim 1, wherein the central control unit comprises a monostable having a positive feedback circuit to keep the monostable in its set condition, a trigger circuit for detecting the changes in resistance of the detection circuit and converting such changes into changes in potential to cause the monostable to become set when such a change occurs, and an alarm generating circuit which is operable to operate an alarm whenever the monostable is in the set condition.

8. Security equipment as claimed in claim 7, wherein said positive feedback circuit of said monostable contains a timing circuit which is operable to reset said monostable after it has been in the set condition for a predetermined period of time.

9. Security equipment as claimed in claim 1, further comprising a respective diode connected in parallel with each respective said resistance element associated with a normally-open switch means in the direction of current flow, the arrangement being such that the normal voltage drop across said resistance element, and hence across said diode, is lower than the offset of said diode.

10. Security equipment as claimed in claim 1, wherein a plurality of said detection circuits are provided each protecting an individual zone of a premises to be protected, the various said detection circuits being connected in series with one another, said equipment further comprising a zone switch for selectively shorting out one or more of said series-connected detection circuits so that it or they become inoperative, and means for inhibiting operation of said alarm for a short period in order that current perturbations which occur in the series-connected detection circuits during such zone switching do not actuate said alarm.

* * * * *